United States Patent [19]

Glicksman

[11] Patent Number: 4,534,119

[45] Date of Patent: Aug. 13, 1985

[54] APPARATUS AND METHOD FOR DRYING INSULATION

[75] Inventor: Leon R. Glicksman, Lynnfield, Mass.

[73] Assignee: Massachusetts Institute of Technology, Cambridge, Mass.

[21] Appl. No.: 506,574

[22] Filed: Jun. 22, 1983

[51] Int. Cl.[3] ..... F26B 13/26

[52] U.S. Cl. ..... 34/95; 34/9; 52/209; 52/302; 98/31

[58] Field of Search ..... 34/9, 95; 98/31, 43 A; 52/169.14, 169.5, 209, 302; 210/770

[56] References Cited

U.S. PATENT DOCUMENTS

| | | | |
|---|---|---|---|
| 1,931,066 | 10/1933 | Eckert | 98/31 |
| 2,438,528 | 3/1948 | Wilhelm et al. | 52/302 |
| 2,833,229 | 5/1958 | Donegan | 52/302 |
| 2,839,789 | 6/1958 | Adams | 52/302 |
| 3,293,810 | 12/1966 | Cox et al. | 52/303 |
| 4,064,666 | 12/1977 | Kinlaw | 52/209 |
| 4,432,273 | 2/1984 | Devitt | 98/43 A |

OTHER PUBLICATIONS

Tobiasson, et al., "Can Wet Insulation Be Dried Out?", Proceedings of the DOE-ORNL/ASTM Symposium on Thermal Insulation, Materials and Systems, (1981).

*Primary Examiner*—Larry I. Schwartz
*Assistant Examiner*—Steven E. Warner
*Attorney, Agent, or Firm*—Arthur A. Smith, Jr.; Thomas J. Engellenner

[57] ABSTRACT

A wicking apparatus for drying insulation wet with water, particularly insulation in flat roofing systems and wall systems, is disclosed consisting of a hollow device, capable of penetrating the exterior weather shield or siding to the insulation to create a passageway from the insulation to an external environment where moisture can evaporate, and a wick disposed within the passageway to transport moisture by capillary action from the insulation to the external environment. In retrofit applications, the method resides in penetrating the weather shield or insulation in at least one location and deploying the wicking apparatus to induce drying; in new applications a network of moisture-transporting channels can also be employed within the insulation itself together with one or more wicking apparatuses to further aid in drying.

17 Claims, 3 Drawing Figures

APPARATUS AND METHOD FOR DRYING INSULATION

BACKGROUND OF THE INVENTION

The invention relates to thermal insulation systems and, in particular, to an apparatus for drying built-up or compact roof insulation and wall insulations. Moisture in insulated built-up or compact roofing systems causes many premature roof failures and unwanted energy losses. Such roofing systems are installed on most commercial flat roofs. Typically, the systems are made up of metal, concrete or wood decks supported by heavy wood beams or steel I beams. The decks are covered with vapor barriers upon which the insulation, which is usually provided in board form ranging from 2×4 foot to 4×8 foot panels, is laid. The insulation in turn is covered with between two to four felt layers and an asphalt coating or a continuous weather barrier.

Moisture can enter the roofing system through minor cracks which may develop at the seams or from weathering. Poorly designed roofs develop ponding which increases the possibility of water intrusion. When the insulation becomes wet, or partly so, the air or gas spaces become filled with water.

Heat transmission through the water-filled spaces approaches the rate of conductivity of water which is over 24 times greater than that of air. Additionally, if the moisture freezes, heat transmission can increase by as much as 90 times the original rate. Moreover, moisture can damage the felt material and cause further structural damage. Approximately three billion square feet of new roofs were installed in 1981 at a cost of about 3.6 billion dollars, of which 75% accounted for reroofing.

The conventional method for attempting to remove moisture from roof insulation is to attempt to seal all the cracks and then employ top relief vents, edge vents, breathing top membranes and the like to permit moisture to evaporate from insulation. However, studies suggest that it is very difficult to dry out wet roof insulation in such a manner. Recent tests conclude that present methods for drying insulation will not work once the insulation contains any appreciable water. Another proposal has been to eliminate the lower vapor barrier in insulation systems so that evaporation can occur at the bottom of the insulation system. This solution will only be effective if the vapors can pass to the building below and can present additional problems if a major task occurs in the insulation system; without a lower barrier, leaking water will also pass unhindered to the building below. Further, the removal of the lower vapor barrier will allow interior moisture to condense in the insulation system. See, generally, Tobiasson et al. "Can Wet Insulation Be Dried Out?", Proceedings of the DOE-ORNL/ASTM Symposium on Thermal Insulation, Materials and Systems (1981), for a further discussion of the unsolved problems of wet roof insulation.

There exists a need for better apparatuses and methods for drying wet insulation, particularly in compact roofing systems. An apparatus which can be applied as a retrofit solution to the problem of wet insulation as well as modified structures for new roofing systems to avoid the problem would satisfy long-felt needs in this industry.

Equally important is the problems of moisture in building walls. If a building is constructed without a carefully installed vapor barrier or insulation is added to the walls of an existing building without a vapor barrier, water vapor penetrates the insulation and the existance of large temperature changes within the insulation causes condensation to occur within the wall cavity. Present efforts in the industry are directed at finding a retrofit insulation which can be installed in an existing wall without major reconstruction and which prevents moisture from penetrating it. Foam insulations which are pumped into the wall cavities have been found to shrink upon curing leaving gaps and cracks for moisture penetration and foams have been suspected of causing interior air pollution. At present there is no widely accepted system for retrofit wall cavity insulation. There exists the need for a reliable method to remove any moisture which condenses in an insulated wall.

SUMMARY OF THE INVENTION

I have discovered that a simple but effective solution to the problem of wet insulation resides in a wicking apparatus and method for transporting moisture by capillary action or the like from the insulation to an external environment where it can evaporate. In practice, experiments with my invention have demonstrated that the rate of moisture transfer can be increased up to fifteen-fold by using my wicking apparatus instead of a conventional vent apparatus.

In one embodiment my invention comprises a hollow device capable of penetrating through a roof membrane or the like and reaching into the insulation to create a passageway from the insulation to an extrnal environment where the moisture can evaporate. A wick is disposed within the passageway to contact the condensed liquid within the insulation system to transport the moisture by capillary action. In one preferred embodiment, the hollow device is spike-shaped and may be inserted into holes drilled or punched through the outer membrane of the insulation system. The portion of the hollow device exposed to the external environment can have one or more holes so that air can circulate over the wick and contact the outer surface of the wick so that moisture may evaporate from the wicking material to the environment. When used to penetrate horizontal membranes, such as roof tops, a skirt may be employed to seat the apparatus and seal the hole.

In another aspect my invention may be employed as part of new roof construction by periodically placing my wicking apparatus at various locations upon the roof. In new systems, the wicks may be greatly extended into the insulation or may be connected into a network of channels designed to carry the moisture should the new insulation become wet.

The invention will next be described in connection with various preferred embodiments designed for roofing applications. However, it should be clear that various changes and modifications may be made without departing from the spirit or scope of my claims. Various materials may be used as wicks, such as fiberglass, cotton, felt, synthetic fabrics, metallic gauze and the like. Changes to the design of the hollow device itself, together with its skirt, holes and, when needed, rain guards, are within the capability of those skilled in this art. The moisture channels for new roofs may employ the same types of materials used for wicks or may simply comprise troughs or tubes into which moisture can be collected and transported to the wicking apparatuses. Where new roof systems are constructed by laying down preformed sheets of insulation, my apparatus and the channels may be incorporated into the sheets as they are formed and assembled by conventional techniques.

My wicking means can also comprise multiple layers of wick material arranged in a variety of configurations at the exterior of the device to maximize wick surface area in contact with air and to minimize clogging of wicks due to deposition of dissolved materials from the evaporated liquid. Additionally, interrupted copper, aluminum or other high conductivity filaments can be woven into the wick along its length. Thus, when the wick is wet, a good conduction path is set up from filament to filament allowing heat transfer from the interior of the building along the wick to limit the occurrence of frosting and freeze up of the wick. When the wick is dry there is substantial thermal resistance from filament to filament severly limiting any heat loss along the wick.

Moreover, my invention can find use in applications other than roofing whenever it is necessary to dry wet insulation. For example, wall insulation, such as in large walk-in refrigeration units or liquified gas tanks, can be dried by my invention as well. In general, whenever wet insulation poses a problem, my wicking apparatus can be expected to achieve results superior to conventional venting. In walls, the wick can be installed in a similar fashion. One end of the wick is in contact with the insulation in the wall cavity which in some cases, e.g. fiberglass, acts to transport the condensed liquid to the wick. The wick serves to transport the liquid to the exterior where it is evaporated. On the exterior, the wick can be placed flat along the exterior wall with a weather shield around it, air passages below, to make it less obtrusive visually. In some applications when a rigid material such as a metal is used as the wick it can support itself and a hollow tube is unnecessary.

DESCRIPTION OF PREFERRED EMBODIMENTS

Figure 1:
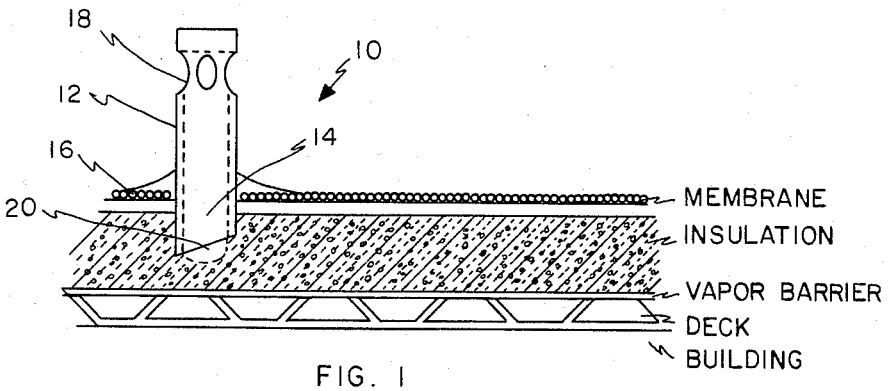
FIG. 1 is a partial cross-sectional, schematic view of my apparatus employed upon a roof.

In FIG. 1 my wicking apparatus 10 is shown comprising a hollow device 12, wick 14, and skirt 16. The opening 20 at the bottom of the device 12 permits the wick 14 to contact wet insulation while one or more holes 18 at the top of the device 12 permits moisture drawn up through the wick 14 to evaporate. The device may also include a rain guard or cap (not shown) to prevent moisture from entering the insulation through the device 12. The distance between the holes 18 and the roof should be large enough that any pooling of water on the roof will not flood the device 12. Skirt 16 can be sealed to the roof with any suitable, water-impervious adhesive or flexible gasket.

Figure 2:
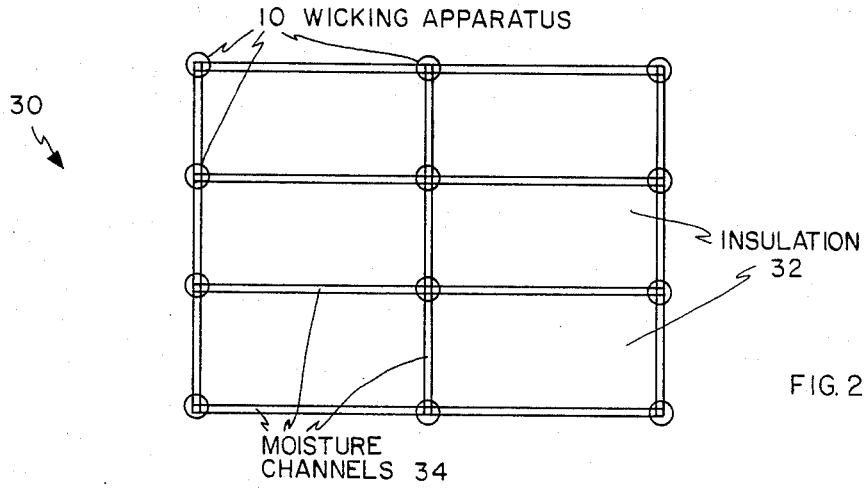
FIG. 2 is a schematic, top view of my invention installed as part of a new roof system.

In FIG. 2 a new roof system 30 is shown employing a plurality of my wicking apparatuses 10 together with moisture channels 34. In practice, a new roof system would incorporate troughs, perforated tubes, or wicking fabrics at the moisture-carrying channels 34, particularly when the insulation material 32 to be used is a closed-cell foam or similar material that does not transport moisture well. The insulation 32 is then put in place, my wicking apparatuses 10 are connected to the network of moisture channels 34 at suitable locations, and the roof membrane completed by conventional roofing techniques. The moisture channels may also be continuous surfaces, rather than channels to cover the entire area of the insulation.

Figure 3:
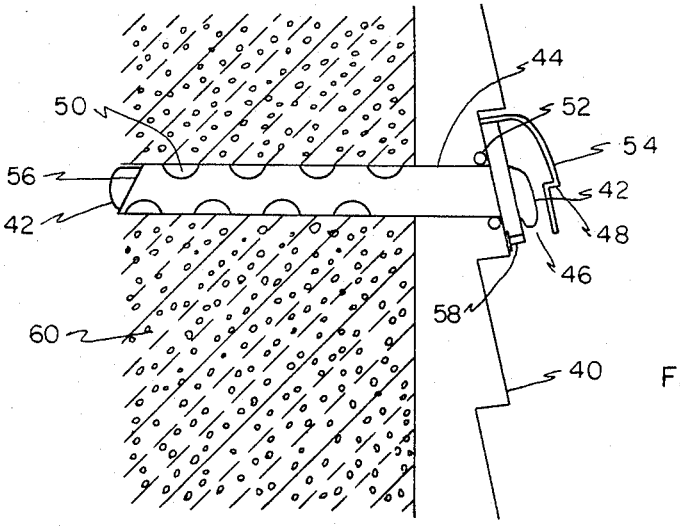
FIG. 3 is a partial cross-sectional, schematic view of my apparatus employed in a wall.

FIG. 3 shows the wicking system used in walls. The wick system is placed in holes drilled through the exterior wall 40. The wick 42 is placed inside of a support tube 44 which has holes 50 and an open end 56 allowing contact between the wick and the wet wall cavity 60. On the exterior, the wick is placed along the exterior wall protected by the shield 54 from precipitation. The holes 48 and slot 46 allow air circulation over the wick to evaporate moisture. Gaskets or O-rings, 52, prevent air infiltration through the holes in the exterior wall. A shield 58 under the wick prevents any moisture from the wick contacting the exterior surface of the building.

What is claimed is:

1. An apparatus for drying insulation after installation comprising:

(a) a penetrating means for creating a passageway between the space occupied by the insulation and an exterior environment where unwanted moisture can be carried away by evaporation; and (b) wicking means within the passageway for transporting moisture by capillary action from the insulation to the external environment; and wherein the penetrating means is a hollow device adapted to receive the wicking means within itself and having at least one opening through which the wicking means may contact the insulation and further having at least one other opening through which moisture may evaporate from the wicking means to the external environment.

2. The apparatus of claim 1 wherein the wicking means further comprises a fiberglass wick.

3. The apparatus of claim 1 wherein the wicking means further comprises a synthetic fabric wick.

4. The apparatus of claim 1 wherein the wicking means further comprises a felt wick.

5. The apparatus of claim 1 wherein the wicking means further comprises a cotton wick.

6. The apparatus of claim 1 wherein the wicking means further comprises a metallic gauze wick.

7. The apparatus of claim 1 wherein the apparatus further comprises a sealing means for sealing the penetrating means to an outer surface of the insulation.

8. The apparatus of claim 7 wherein the apparatus is adapted for drying roof insulation and the sealing means is a skirt situated about the penetrating means and is seated upon the roof in use.

9. The apparatus of claim 1 wherein the apparatus is adapted for drying wall insulation and the penetrating means is secured to the wall in use.

10. The apparatus of claim 1 wherein the wicking means further comprises a mult-layered wick situated at a location where passage way meets the external environment.

11. The appartus of claim 1 wherein the wicking means further comprises a wick with at least one thermally conductive filament.

12. The apparatus of claim 1 wherein the wicking means further compromises a wick with a plurality of discontinuous, thermally conductive filaments.

13. A method of drying wet insulation material when the material is separated from an external environment by a sealing surface, the method comprising:

(a) penetrating the surface to create a passageway between the material and the external environment;

(b) disposing a housing within said passageway, said housing having a wicking means within itself and having at least one opening through which the wicking means may contact the insulation and further having at least one opening through which moisture can evaporate from said wicking means to said external environment; and (c) sealing said housing to said sealing surface.

14. A roofing system comprising:

(a) a support structure situated upon the roof;

(b) insulating material adapted to be received within the support structure;

(c) a sealing means for sealing the insulation into the support structure;

(d) at least one wicking apparatus comprising:

(i) a penetrating means for creating a passageway between the insulating material and an external environment; and (ii) a wicking means within the passageway for transporting moisture to the external environment and (e) a network of moisture-carrying channels within the insulating material for transporting moisture to the wicking means; and wherein the wicking apparatus, insulating material and moisture-carrying channels are formed as cellular units adapted to be received by the support structure and then covered by the sealing means.

15. The system of claim 14 wherein the moisture-carrying channels further comprise wicking material.

16. The system of claim 14 wherein the moisture-carrying channels further comprise troughs.

17. The system of claim 14 wherein the moisture-carrying channels further comprise perforated tubes.

* * * * *